US005530529A

United States Patent [19]

Henderson et al.

[11] Patent Number: 5,530,529

[45] Date of Patent: Jun. 25, 1996

[54] FLUID SENSING APARATUS

[75] Inventors: Thomas A. Henderson, Rochester; Gary A. Denton; Nancy B. Goodman, both of Webster, all of N.Y.

[73] Assignee: Xerox Corporation, Stamford, Conn.

[21] Appl. No.: 360,484

[22] Filed: Dec. 21, 1994

[51] Int. Cl.[6] ..... G03G 21/00

[52] U.S. Cl. ..... 355/246; 355/256

[58] Field of Search ..... 355/245, 246, 355/256, 203, 208, 257, 258, 298; 118/659, 660, 661, 662; 356/432, 435, 436, 441, 445; 347/7, 19

[56] References Cited

U.S. PATENT DOCUMENTS

| | | | |
|---|---|---|---|
| 3,926,145 | 12/1975 | Muth | 355/208 |
| 3,999,047 | 12/1976 | Green | 235/151.3 |
| 4,037,973 | 7/1977 | Carr | 356/206 |
| 4,101,874 | 7/1978 | Denison et al. | 340/606 |
| 4,193,694 | 3/1980 | Smith | 356/407 |
| 4,431,300 | 2/1984 | Snelling | 355/14 |
| 4,441,374 | 4/1984 | Suzuke | 73/864.12 |
| 4,504,444 | 3/1985 | Englander | 422/100 |
| 4,550,327 | 10/1985 | Miyakawa | 347/19 X |
| 4,637,730 | 1/1987 | Ponstingl et al. | 356/411 |
| 4,653,078 | 3/1987 | Aritomi et al. | 377/10 |
| 4,795,707 | 1/1989 | Niiyama et al. | 435/288 |
| 4,901,024 | 2/1990 | Miyake et al. | 324/438 |
| 4,981,362 | 1/1991 | deJong et al. | 356/436 |
| 5,003,352 | 3/1991 | Duchesne et al. | 355/256 |
| 5,051,759 | 9/1991 | Karita et al. | 347/7 X |
| 5,070,346 | 12/1991 | Mochizuki et al. | 347/7 |
| 5,192,972 | 3/1993 | Kroll et al. | 355/208 |
| 5,220,384 | 6/1993 | Landa et al. | 355/256 |
| 5,241,189 | 8/1993 | Vandagriff et al. | 356/435 X |
| 5,289,211 | 2/1994 | Morandotti et al. | 347/7 |
| 5,315,376 | 5/1994 | Wada et al. | 356/432 |
| 5,319,421 | 6/1994 | West | 355/256 |
| 5,365,559 | 11/1994 | Hsueh et al. | 377/10 |
| 5,373,366 | 12/1994 | Bowers | 356/435 |

*Primary Examiner*—Sandra L. Brase
*Attorney, Agent, or Firm*—Don L. Webber

[57] ABSTRACT

A apparatus for sensing fluid parameters such as optical density, light transmittance, electrical conductivity and/or other characteristics of a fluid, including an emitter adapted to project a light beam and an electrical current and a detector adapted to transmit a first signal in response to receiving the light beam and a second signal in response to receiving the electrical current. A processor determines a set of fluid parameters according to the signals transmitted from the detector. A measured amount of diluent may be added to the fluid to increase light transmittance and/or electrical conductivity so as to enhance sensor operation and sensitivity.

26 Claims, 6 Drawing Sheets

FLUID SENSING APARATUS

The present invention relates generally to fluid sensors that may be employed a variety of devices to include copying and printing machines, and more particularly concerns optical and conductivity sensors capable of determining fluid flow rates, density, particulate content, light transmittance, particulate attributes and/or other fluid characteristics.

In particular, systems involving fluid flows may require that a variety of components and parameters of those fluids be closely monitored. Arrays of various types of fluid sensors are being incorporated into a variety of technologically advanced machines; these sensors must be reliable and durable, so as to accurately monitor the requisite aspects of moving fluids in a variety of environments. Increased diagnostic, control and automation capabilities have also made it desirable to position reliable light and conductivity emitter and receptor sensing systems in multiple locations in a fluid flow path of a liquid circulating system. The connection of these emitters and receptors by power/data cables, optic fibers or other means to the remote data collection/analysis points can result cost savings, increased reliability and improved overall system performance.

For example, copying and printing machines using liquid inks/toners, fuser oils or other fluids may require sensors to accurately sense and evaluate the density, particulate content, light transmittance, flow rates and other aspects of the liquids used. In such applications, a flowing material may be illuminated with a collimated beam of light emitted from a light emitter, such as an infrared LED (light emitting diode), or by variety of light sources. A portion of the light directed in this fashion at a fluid can pass through a portion of the fluid to a light detector or other sensor, so that flow speed and other fluid characteristics may be monitored.

Various sensors have been devised for sensing various fluids and their parameters and flow conditions, including those described in the following disclosures which appear to be relevant:

U.S. Pat. No. 5,365,559

Patentee: Haueh et al

Issued: Nov. 15, 1994

U.S. Pat. No. 5,220,384

Patentee: Landa et al

Issued Jun. 15, 1993

U.S. Pat. No. 5,192,972

Patentee: Kroll et al.

Issued: Mar. 9, 1993

U.S. Pat. No. 4,981,362

Patentee: deJong et al.

Issued: Jan. 1, 1991

U.S. Pat. No. 4,901,024

Patentee: Miyake et al

Issued: Feb. 13, 1990

U.S. Pat. No. 4,795,707

Patentee: Niiyama et al

Issued: Jan. 3, 1989

U.S. Pat. No. 4,653,078

Patentee: Aritomi et al

Issued Mar. 24, 1987

U.S. Pat. No. 4,637,730

Patentee: Ponstingl et al.

Issued: Jan. 20, 1987

U.S. Pat. No. 4,504,444

Patentee: Englander

Issued: Mar. 12, 1985

U.S. Pat. No. 4,441,374

Patentee: Suzuki

Issued: Apr. 10, 1984

U.S. Pat. No. 4,431,300

Patentee: Snelling

Issued: Feb. 4, 1984

U.S. Pat. No. 4,193,694

Patentee: Smith

Issued: Mar. 18, 1980

U.S. Pat. No. 4,101,874

Patentee: Denison et al.

Issued: Jul. 18, 1978

U.S. Pat. No. 4,037,973

Patentee: Carr

Issued: Jul. 26, 1977

U.S. Pat. No. 3,999,047

Patentee: Green

Issued: Dec. 21, 1976

U.S. Pat. No. 5,365,559 discloses a particle counting system for counting particles contained in a liquid sample. The system includes a flow cell through which the liquid sample moves, a light source for irradiating a light beam to the sample liquid in the flow cell, a detector for detecting pulse-wise signal scattered from the particles by the irradiating of the light beam, and a computer for obtaining the total particle counting value contained in the liquid sample.

U.S. Pat. No. 5,220,384 discloses a liquid toner based imaging machine including a movable photoconductive member carrying an electrostatic latent image. A developing station containing a source of toner liquid that includes charged toner particles. The developing station includes a developer electrode charged to a voltage; the deposition of the toner during development of the image is inhibited by coating the surface of the electrode facing the carrier with a polymer material having a conductivity increasing additive.

U.S. Pat. No. 5,192,972 discloses a toner mix monitoring system which periodically reads a simulated nominal toner concentration. A difference between the monitored output and the expected toner concentration is applied to a compensation device. The simulated nominal toner concentration signal is obtained by periodic alignment of the toner monitor with a magnetically permeable member.

U.S. Pat. No. 4,981,362 discloses a system for measuring particle concentration in a fluid passed between a movable window and a single photodetector. A single set of optics, detectors and amplifiers is used, so as to eliminate errors that may arise from a relative drift between two detectors.

U.S. Pat. No. 4,901,024 discloses a particle analyzer which comprises a constricted passage for analyzing fine particles contained in a suspension. The system includes a detector having upstream and downstream electrodes disposed in the upstream and downstream passages, respectively, so as to confront with each other for detecting the fine particles being passed through the constricted passage.

U.S. Pat. No. 4,795,707 discloses an electrochemical sensor having a working electrode for detecting hydrogen peroxide. A cylinder portion of the sensor is embedded in the layer containing the hydrogen peroxide decomposing enzyme, but is not in contact with the layer containing the hydrogen peroxide decomposing enzyme.

U.S. Pat. No. 4,653,078 discloses a method of counting red blood cells suspended in a blood sample which can judge the presence or absence of clogging in the sample passage system of a blood cell counting apparatus. Final detected counts can be displayed on a CRT display.

U.S. Pat. No. 4,637,730 discloses an optical absorption meter including a light source unit of a broad wavelength having a source of constant energy which is collimated into two light beams, one of which is transmitted through the liquid to be measured, and another beam which is transmitted through a conductor and acts as a reference beam, and a detector unit which contains two photocells, one photocell for measuring the beam transmitted through the liquid to be measured, and another photocell which measures the reference beam.

U.S. Pat. No. 4,504,444 discloses an apparatus and method for accurately diluting an unknown solution. The apparatus is capable of accurately diluting a concentrated solution into a large volume in a reproducible manner. A process of diluting is disclosed which minimizes the deviations in concentrations from batch to batch. The apparatus includes capillary tubing and stems which enhance the operator's ability to make accurate and reproducible dilutions.

U.S. Pat. No. 4,441,374 discloses a device for diluting liquid sample feeds both the liquid sample and a diluent solution to a mixing point through a first and a second roller pumps respectively, so that the concentration of the liquid sample in the resultant mixture is controlled by regulating the revolving speeds of the first and second roller pumps.

U.S. Pat. No. 4,431,300 discloses a device for developability sensing in electrophotographic printing using tin oxide coated (NESA) glass plates. Alternating potential applied to the plates is used to sense particulate toners.

U.S. Pat. No. 4,193,694 discloses a color monitoring device is provided for measuring the concentration of a colored component in a flowing gas or liquid stream in which polychromatic light is passed through a frosted lens, then through a transparent sight tube through which the flowing stream passes. The light then passes through a second frosted lens, then through a sight mask which divides the light into two beams, one beam then passing through a first filter and the second beam passing through a second filter, the light beams passing through the filters then being directed to a first then second photoconductor.

U.S. Pat. No. 4,101,874 discloses a fluid flow indicator suitable for mounting behind an opening in an instrument panel contains a six-bladed wheel which rotates according to the flow of fluid passing through orifices in the indicator housing. Each of the six blades of the wheel contains a small magnet oppositely polarized from the magnets in the adjacent blades to create alternate magnetic fields that pass through a pickup coil embedded in the housing, providing visible indication of fluid flow and an alarm system for indicating if the fluid flow stops or varies from some predetermined value.

U.S. Pat. No. 4,037,973 discloses a device for measuring particles in a liquid, utilizing a light source for the illumination of two detectors, one through a relatively short distance and the other through a relatively long distance. A reference signal produced by the first cell is supplied to an amplifier and indicator, and a measurement signal produced by the second detector is supplied to the amplifier and indicator. The two detectors and light source are contained in a small housing, remote from the amplifier and indicator.

U.S. Pat. No. 3,999,047 discloses a method and apparatus for analyzing an illuminated subject. A first signal is produced which represents a first predetermined wavelength band of the subject modified illumination at a region in the subject. A second signal is produced which represents a second predetermined wavelength band of the subject modified illumination at the region. The two wavelength bands are selected to produce differential contrast between at least two different regions in the subject.

In accordance with one aspect of the present invention, there is provided a apparatus for sensing a fluid including an emitter adapted to project a light beam and an electrical current into the fluid and a detector adapted to transmit a first signal in response to receiving the light beam and a second signal in response to receiving the electrical current. The apparatus also includes a processor for determining a fluid parameter according to the first and second signals transmitted from the detector.

In accordance with another aspect of the present invention, there is provided a printing machine of the type including a fluid sensor. The sensor includes an emitter adapted to project a light beam and an electrical current into the fluid and a detector adapted to transmit a first signal in response to receiving the light beam and a second signal in response to receiving the electrical current. The sensor also includes a processor for determining a fluid parameter according to the first and second signals transmitted from the detector.

Other aspects and features of the present invention will become apparent as the following description proceeds and upon reference to the drawings, in which.

While the present invention will hereinafter be described in connection with various embodiments thereof, it will be understood but is not intended to limit the invention to these embodiments. On the contrary, it is intended to cover all alternatives, modifications, and equivalents as may be included within the spirit and scope of the invention as defined by the appended claims.

Figure 10:
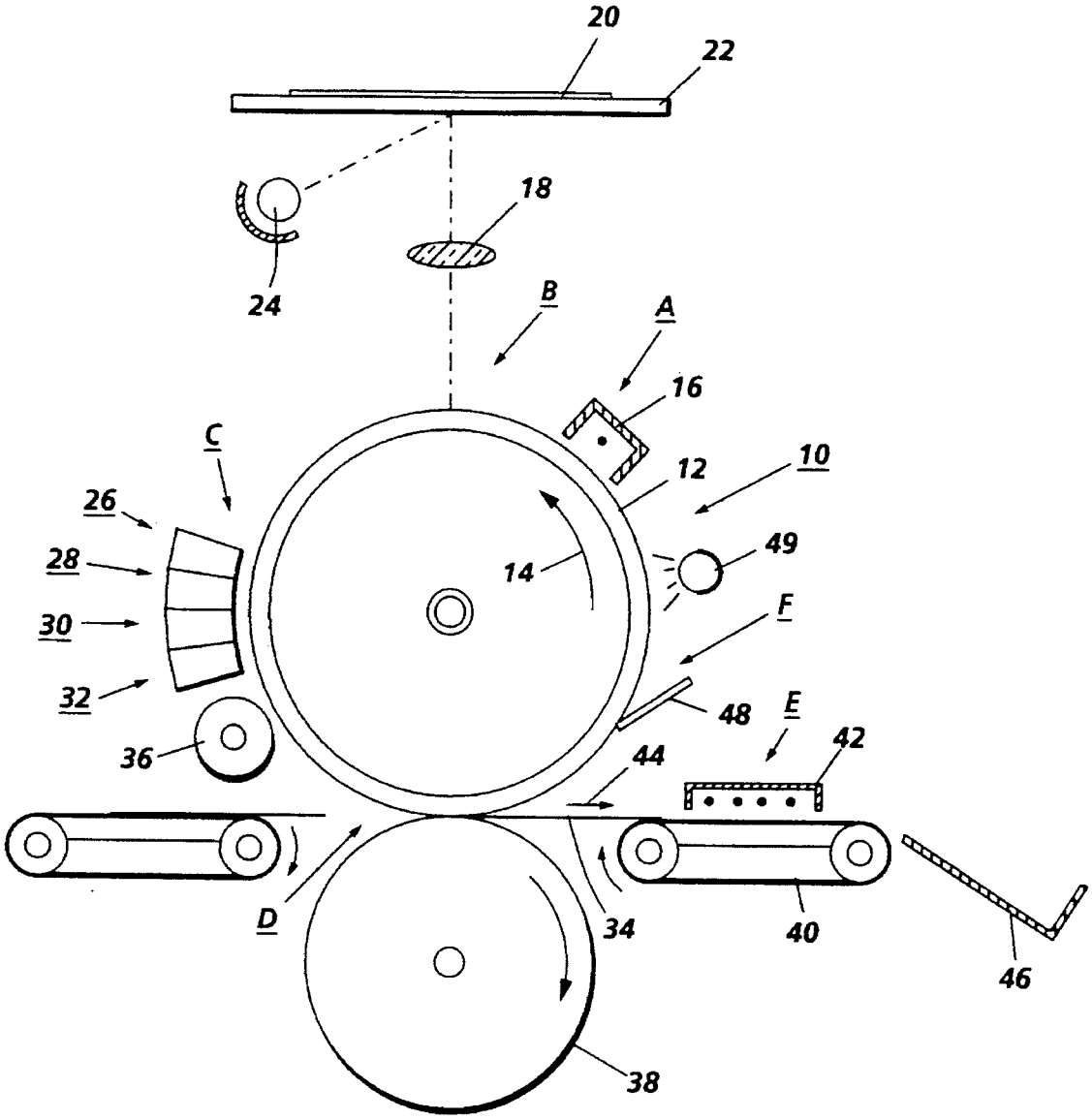
FIG. 10 depicts a multicolor electrophotographic liquid toner ink printing machine as may be employed in accordance with the present invention.

For a general understanding of the features of the present invention, reference is made to the drawings. In the drawings, like reference numerals have been used throughout to designate identical elements. FIG. 10 is a schematic elevational view illustrating an electrophotographic printing machine incorporating the features of the present invention therein. It will become apparent from the following discussion that the apparatus of the present invention may be equally well suited for use in a wide variety of printing machines and is not necessarily limited in its application to the particular embodiment.

Turning now to FIG. 10, the electrophotographic printing machine employs a photoconductive member having a drum 10 mounted rotatably within the printing machine. A photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with the machine logic to synchronize the various operation thereof with the rotation of drum 10. In this manner, the proper sequence of events is produced at the respective processing stations.

Drum 10 initially rotates the photoconductive surface 12 through charging station A. At charging station A, a corona generating device, indicated generally by the reference numeral 16, sprays ions onto photoconductive surface 12 producing a relatively high, substantially uniform charge thereon.

Next, the charged photoconductive surface is rotated on drum 10 to exposure station B. At exposure station B, a light image of an original document is projected onto the charged portion of the photoconductive surface 12. Exposure station B includes a moving lens system, generally designated by the reference numeral 18. An original document 20 is positioned face down on a generally planar, substantially transparent platen 22. Lamps 24 are adapted to move in a timed relationship with lenses 18 to scan successive incremental areas of original document 20. In this manner, a flowing light image of original document 20 is projected onto the charged portion of photoconductive surface 12. This selectively dissipates the charge on photoconductive surface 12 to record an electrostatic latent image thereon corresponding to the informational areas in original document 20. Selected optical filters (not shown) having colors complimentary to the color of the respective liquid toner are interposed into the light path to optically filter the light image. While a light lens system has heretofore been described, one skilled in the art will appreciate that other techniques may be used, such as a raster output scanner employing a modulated laser beam to discharge selected areas of the photoconductive surface to record the electrostatic latent image thereon.

After exposure, drum 10 rotates the electrostatic latent image recorded on photoconductive surface 12 to development station C. Development station C includes a plurality of developer units, generally indicated by the reference numerals 26, 28, 30 and 32. Each of the developer units are substantially identical to one another and will be described hereinafter in greater detail with reference to FIGS. 1–6 inclusive. Each developer unit extrudes a liquid developer material onto the electrostatic latent image so as to develop the electrostatic latent image, with the respective colored toner particles. By way of example, developer unit 26 extrudes cyan colored liquid toner, developer unit 28 extrudes magenta colored liquid toner, developer unit 30 extrudes yellow colored liquid toner, and developer unit 32 extrudes black colored liquid toner. In operation, a filter is employed in association with lens 18 so that a selected color is transmitted onto photoconductive surface 12 to selectively discharge portions thereof. For example, a red filter is employed to discharge selected areas with the charged areas being developed with the subtractive primary of red, i.e. cyan colored liquid toner. Thus, developer unit 26 develops the charged areas with cyan colored liquid toner when a red filter is employed in association with lens 18. Similarly, when a green filter is employed, developer unit 28 is energized to develop the charged areas with magenta colored liquid toner and, when a blue filter is employed, developer unit 30 is energized to selectively develop the charged area with yellow colored liquid toner. Finally, for those regions of the original documents desired to be reproduced in black, developer unit 32 is energized to develop the charged areas with black colored liquid toner. Each developer unit is selectively actuated during a repeated cycle. By that, it is meant that during the first cycle, when the red filter is employed, developer unit 26 is energized. Subsequently, during the next successive cycle, when the green filter is employed, developer unit 28 is energized. During the third cycle, when the blue filter is employed, developer unit 30 is energized and, finally, during a fourth cycle, developer unit 32 is energized.

Each liquid image may be transferred to a copy sheet after its respective cycle, or successive liquid images may be developed in superimposed registration with one another on photoconductive surface 12 forming a composite multicolor liquid image. The composite multicolor liquid image may then be transferred to the copy sheet 34 after the fourth cycle.

In the electrophotographic printing machine depicted in FIG. 10, a multicolor liquid toner image, i.e. a composite toner image, is formed on photoconductive surface 12 and transferred to a copy sheet. The toner image is transferred at transfer station D.

At transfer station D, the composite multicolor liquid image is transferred to copy sheet 34. Prior to transferring the multicolor liquid image to copy sheet 34, a conditioning roller 36 contacts the multicolor composite liquid toner image. By way of example, conditioning roller 36 may be an electrically biased squeegee roller which is urged against the surface of drum 10 to remove liquid carrier from the background region and to compact the image and remove liquid carrier therefrom in the image regions. Squeegee roller 36 is preferably formed of resilient, slightly conductive polymeric material and is charged to a potential of from several hundred to a few thousand volts with the same polarity as the polarity of the charge on the toner particles. After the composite multicolor liquid image has been conditioned, it advances to transfer station D. A transfer roller 38 is maintained at a suitable voltage and temperature for electrostatic transfer of the image from photoconductive surface 12 to copy sheet 34. Preferably, transfer roller 38 applies pressure and is electrically biased to ensure the transfer of the composite multicolor liquid image to sheet 34.

After the composite multicolor liquid image has been transferred to copy sheet 34, the copy sheet advances on conveyor 40 through fusing station E. Fusing station E includes a radiant heater 42 which radiates sufficient heat energy to permanently fuse the toner to copy sheet 34 in image configuration. Conveyor belt 40 advances the copy sheet in the direction of arrow 44, through radiant fuser 42 to catch tray 46. When copy sheet 34 is located in catch tray 46, it may be readily removed therefrom by the machine operator.

With continued reference to FIG. 10, invariably, some residual liquid toner remains adhering to photoconductive surface 12 of drum 10 after the transfer thereof to copy sheet 34. This material is removed from photoconductive surface 12 at cleaning station F. Cleaning station F includes a flexible resilient blade 48. This blade has the free end portion thereof in contact with photoconductive surface 12 to remove any material adhering thereto. Thereafter, lamp 49 is energized to discharge any residual charge on photoconductive surface 12 preparatory for the next successive imaging cycle. In this way, successive electrostatic latent images may be developed.

The foregoing describes generally the operation of a electrophotographic printing machine including the development apparatus of the present invention therein. The details of the liquid ink toner supply system and sensors of the present invention will be described hereinafter with reference to FIGS. 1–9, inclusive.

Figure 1:
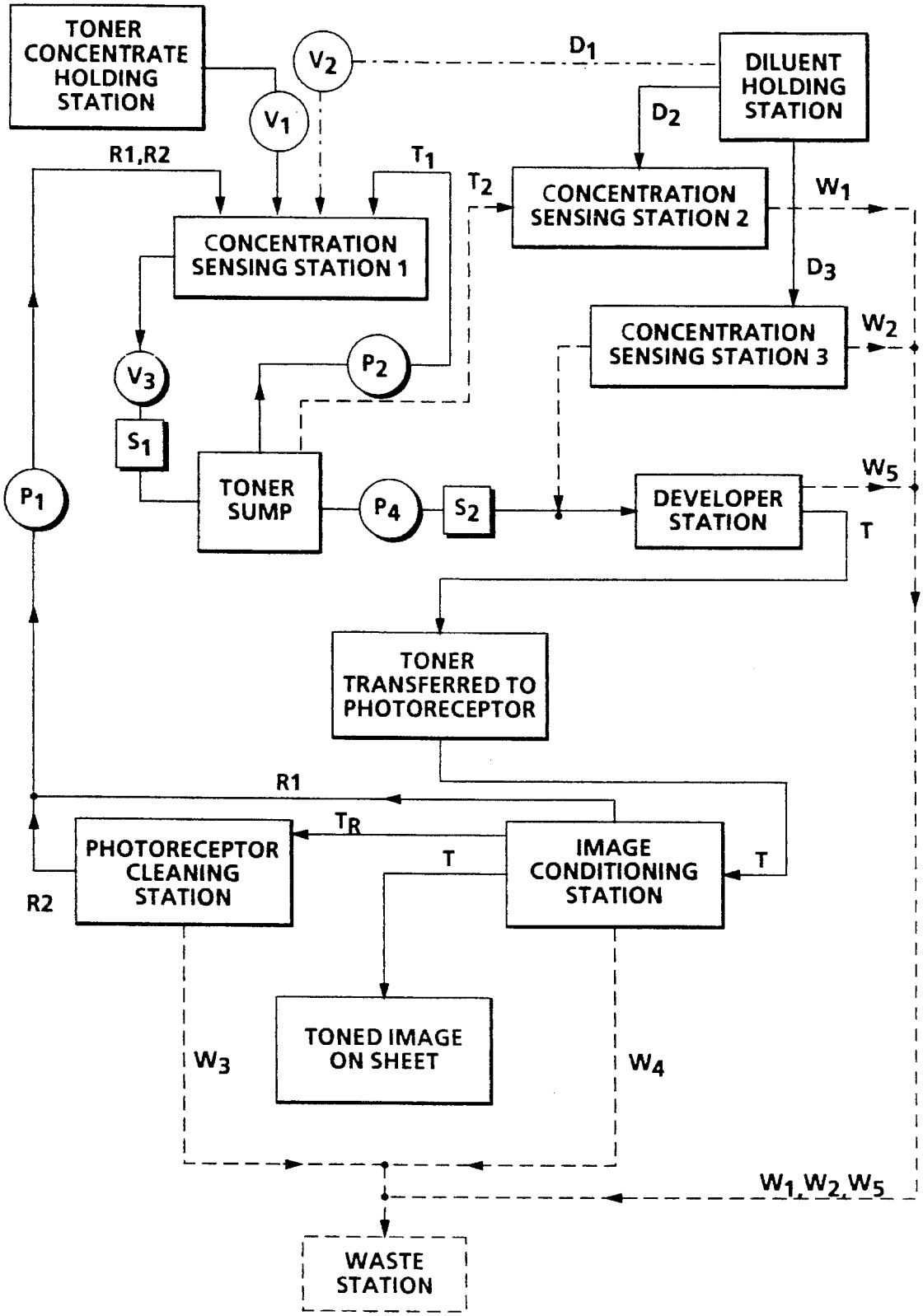
FIG. 1 is an schematic view showing a liquid ink toner supply and sensing arrangement in accordance with the present invention.

FIG. 1 shows an exemplary liquid toner/ink supply system including sensors and sensing systems of the present invention. A ready reserve of toner for use in developing images on sheets is stored in the toner sump. The toner supply system may include one or more sensing stations 1, 2 and/or 3 as shown in FIG. 1, as described in greater detail in association with FIGS. 2 and 9 hereto. A diluent holding station is shown providing diluent to sensing stations 1, 2 and/or 3. Each sensing station may be supplied with diluent from a diluent holding station according to diluent supply lines D1, D2 or D3, respectively. A toner concentrate holding station is also shown, for providing diluent to sensing station according to a fresh toner line and valve V1. Excess solids or viscous liquid waste from the sensing station 2 are preferably transferred to a centralized waste station by waste line (W1) for eventual disposal; likewise, excess solids or viscous liquid waste from the sensing station 3 are may be transferred to a centralized waste station by waste line (W1) or reclaimed and sent to sensing staion 1 (such as R1 and R2), not shown in FIG. 1. Concentration sensing station 1 may utilize diluent from the diluent holding station (flow controlled by valve V2), reclaimed toner from sources R1 and R2 (flow controlled by pump P1), mixed toner from line T1 provided from the toner sump (flow controlled by pump P2) or from the toner concentrate holding station (flow controlled by valve V1 ) to detect toner concentration, toner optical density, toner conductivity and other toner properties and parameters for toner to be provided from sensing station 1 (flow controlled by valve V3) to the toner sump. If the mix in concentration sensing station 1 lacks toner concentrate, as sensed by sensor S1, toner concentrate may be added from the the toner concentrate holding station. Sensor S1 (including sensor heads 66 and 68 such as described in FIGS. 3 through 8) may be used to optically and/or conductively sense toner flow rate, density and/or other properties of the liquid ink as it flows into the toner sump.

Sensor S2 (also including sensor heads 66 and 64 such as described in FIGS. 3 through 8) may be used to optically and/or conductively sense toner flow rate, density and/or other properties of the liquid ink T (flow controlled by pump P4) being provided to a particular developer station. After toner is provided to a developer station, it is transferred to the surface of the photoreceptor according to the latent image developed thereon as described in association with FIG. 10; a waste by product, W5, may be metered from the developer station to the waste station. Before the toner is applied to the photoreceptor is transferred to the sheet, it is conditioned by a image conditioning station (such as roller 36 as shown in FIG. 10). Thereafter, the desired toned image is applied to the sheet. At the same time, a liquid portion R1 of the toner removed at the image conditioning station may be recycled to the toner sump as shown via concentration sensing station 1. Further, a photoreceptor cleaning station, such as including blade 48 as shown in FIG. 10, may reclaim a liquid portion R2 of the toner $T_R$ remaining on the photoreceptor after image transfer to the sheet, for recycling into the toner sump via concentration sensing station 1. Excess solids or viscous liquid waste (W4) from the photoreceptor conditioning station are preferably transferred to a centralized waste station for eventual clean-up or disposal; likewise, excess solids or viscous liquid waste (W3) from the photoreceptor cleaning station are also preferably transferred to a centralized waste station. Again, excess solids or viscous liquid waste (W5) metered from the developer station may also be transferred to a centralized waste station.

While FIG. 1 shows numerous alternative paths and combinations for sensing optical density and conductivity, a preferred system might only permit introduction of diluent (D1) or sump toner (T1) or a combination of the two into concentration sensing station 1. With this arrangement, the quality of the reclaimed (R1, R2) fluids can be optically and conductively verified. If the controller (FIG. 9) indicates degradation of the parameters of the recirculated (R1, R2) fluid, processe failure may be thus identified.

Figure 2:
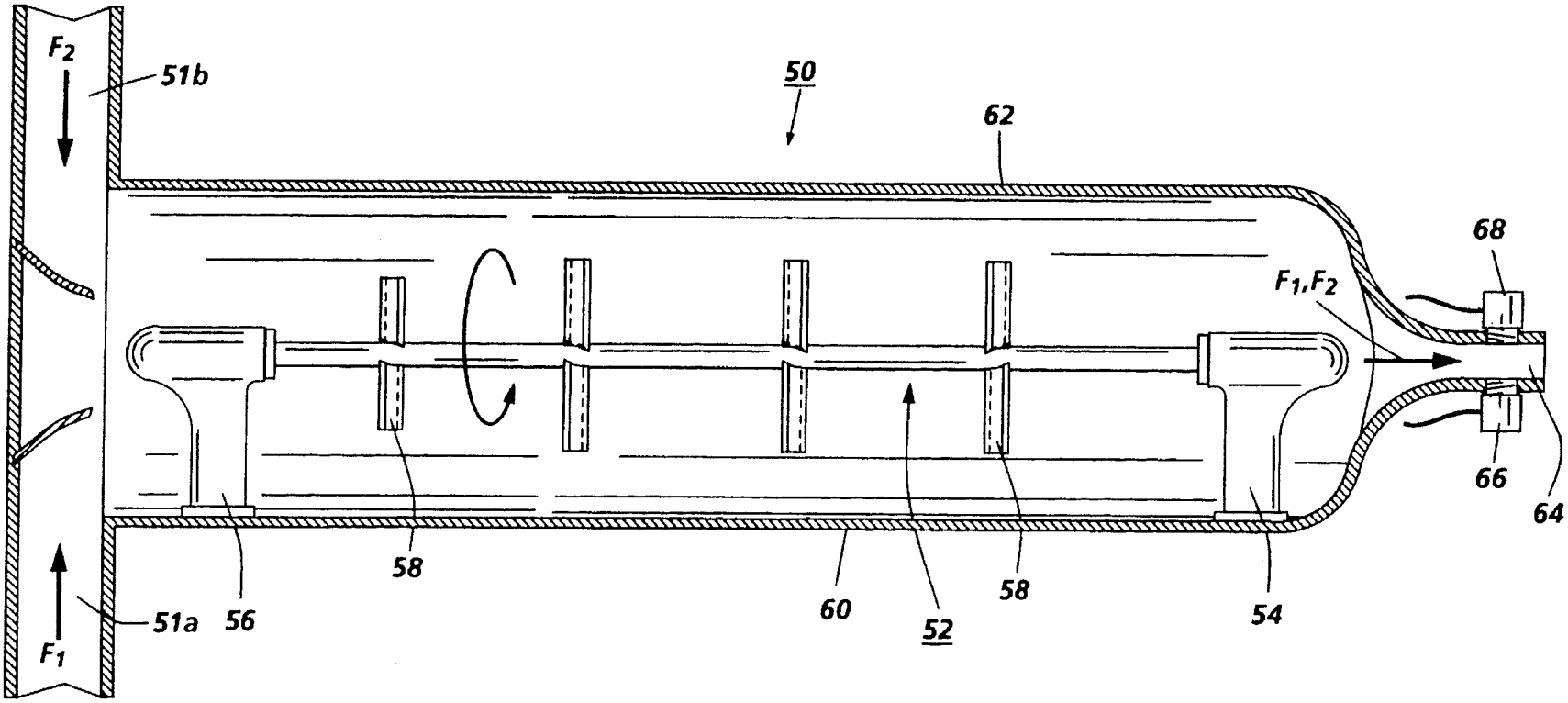
FIG. 2 is an elevational view, partially in section, showing another embodiment of a sensor system in accordance with the present invention.

FIG. 2 shows one embodiment of the dilution assisted toner concentration and flow sensor assembly 50 of the present invention. A first intake 51*a* provides a first fluid (such as a toner or other concentrate) flowing into system 50 according to flow F1 in the direction of the arrow shown. Inlet 51*b* provides a second diluent fluid (such as recycled fluids from the photoreceptor conditioning station or photoreceptor cleaning station or a diluent) to system 50 according to flow F2 in the direction of the arrow shown. In embodiments requiring precise dosages of fluids F1 and F2, a system of valves or pumps such as that described in association with FIGS. 1 or 9 may be employed. Precise dosages of fluids F1 and F2 can prevent mismeasurement of conductivity and other properties. Flows F1 and F2 are mixed by mixing shaft 52 including multidirectional blades 58. One end of shaft 52 is rotatably mounted in mount 54, while the second end of shaft 52 is rotatably mounted in mount 56. The flow of diluent and concentrated toner through system 50 causes shaft 50 to rotate according to flow forces acting on blades 58. The resulting turbulence and mixing that occurs results in a uniform blend of the F1 and F2 fluids. Mixed fluid flows F1 and F2 are combined to flow out of narrowed neck area 64 of system 50, at which point they are sensed by an optical and/or electrical conductive emitter 66 and a photosensitive and or conductive detector 68, as described in greater detail in association with FIGS. 3–8 below.

When fluid F1 in system 50 is a diluent and fluid F2 is a liquid ink toner, the diluent enables or permits more effective optical sensing with emitter 66 and detector 68. The attenuation of light can be used to sense the concentration of toner in a liquid by application of Beer's law to measured data. Critical parameters in the conduct of such fluid measurements include light source intensity from the emitter and the length of the path the light must travel until it is sensed by a detector. For highly absorbing liquids, such as black toner, extremely narrow gaps are otherwise required to obtain a useful attenuation signal, even at low concentrations. The use of very narrow gaps can be problematic, as such "bottlenecks" can foster toner agglomeration at those gaps, which will reduce or eliminate the sensitivity of a concentration measuring light detector. Accordingly, precise dilution of the toner to be sensed by a diluent clear or translucent fluid is dispensed into system 50 can permit additional separation of the emitter and detector. At lower effective concentrations, the requirement of a small emitter to detector gap is relaxed, while problems such as agglomeration and detection sensitivity are reduced or eliminated.

If only sump toner (T1) is circulated, the appropriate conductivity measurement can be made. Optical density for troublesome toners such as black and red is not possible however. To make optical density measurements, "pure" sump toner must be diluted with recirculated fluid (or diluent). Although we can measure conductivity in an undiluted state, conductivity, this measurement may be of limited interest, particularly when measurements on the pure sump are available. When diluent is used in a conductivity sensor, unless the diluent coductivity precisely matches undiluted or sump toner conductivity, this change in conductivity must be accounted for (or compensated for) in processing conductivity sensor readings. The same compensation is also required for optical density measurements on diluted toner. In both cases, the valves and/or pumps (which may be interchangably used depending on system configuration) must precisely control are relevant fluid flows (such as according to the roller pumps as discussed above in U.S. Pat. No. 4,441,374 to Suzuki, incorporated herein by reference) The concentrations of the liquids in the mixture as described herein can thus be is controlled and monitored in both conductivity and optical density measurement.

The concentration of absorbing and/or scattering particles in a fluid can be measured optically using a detector coupled with the sensors of the present invention using Beer's law; $T/T_0=\exp(a\times c\times l)$, where "$T_0$" is the transmitted light intensity at zero concentration, "T" is the transmittance at the unknown concentration ("c"), "l" is the distance through the fluid that the transmitted light travels and "a" is the absorption coefficient. $T_0$ can be determined only once when continuous concentration sensing is conducted; light source intensity variations or other extraneous mechanisms and factors such as transmittance reduction, optical filming and others can cause erroneous measurements of concentration. When "a" is very large, no light at all is transmitted through the fluid, and all sensitivity to the parameter of interest, "c", is lost. To regain sensitivity, small values of "l" are required. (Source intensity can be increased, but in practical terms, small "l" values will be required for black ink.) Other embodiments of the present invention, such as those shown and described in conjunction with FIGS. 3–7, also can rely on the use of emitter and detector systems of the present invention.

In the case of conductivity measurement, the diluent may have additional conductive properties so as to enhance the ability of the conductivity sensor to bridge the fluid gap. Oscillating electric fields may be used for both conductivity measurement and to guard against agglomeration and filming. Embodiments of conductive sensors are also shown and described in conjunction with FIGS. 3–7

Figure 3:
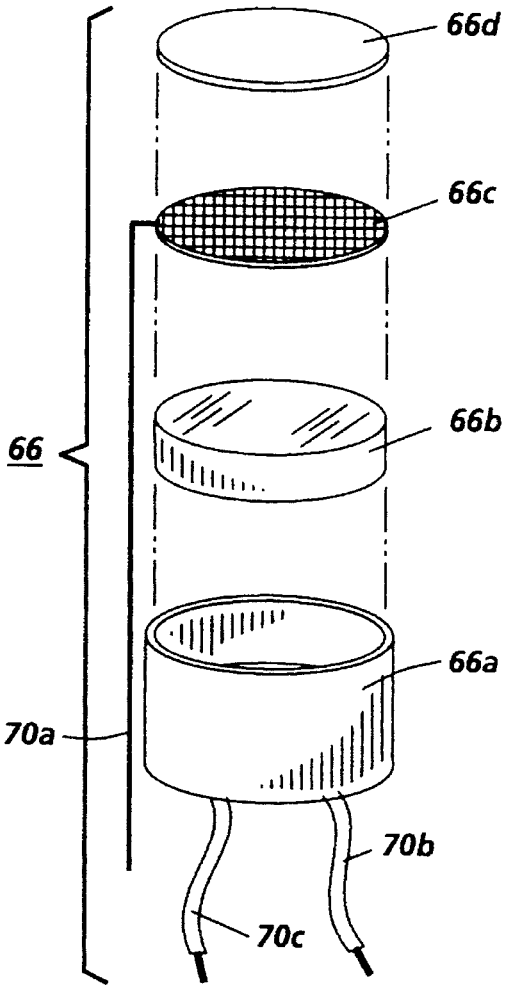
FIG. 3 is an exploded perspective elevational view showing one sensor in accordance with the present invention.
Figure 4:
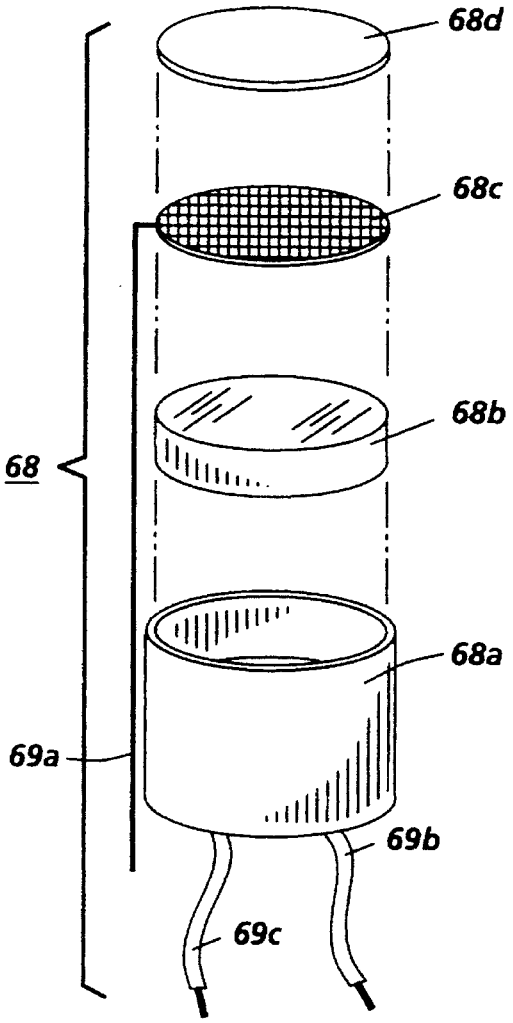
FIG. 4 is an exploded perspective elevational view showing another sensor in accordance with the present invention.

The FIG. 3 and 4 sensor heads may combine conductivity and toner concentration measurement in a single sensing device. An oscillating field applied across a gap (narrowed neck area 64 in FIG. 2) formed by opposing conductive members is employed as a means to measure the current flow. Placement of an optically based toner concentration sensor such that the optical path passes through the electrodes of the conductivity sensor allows the measurement of toner concentration to be accomplished in the same device. The amplitude, frequency and duty cycle of the oscillating field can be chosen such that the toner is prevented from accumulating or permanently depositing onto the electrode/window surfaces.

FIG. 3 shows an exploded view of sensor head 66 which includes a light source **66*a* and a protective lens 66*b*. A light permeable conductive screen 66*c* permits conductivity measurements (described below), while a polymer coating 66*d* prevents fluid or solids agglomeration that might inhibit optical and/or conductivity sensing. The polymer coating material may be a fluorosilicone polymer or a polymer (or other material) having conductive properties. Lead wire 70*a* connects conductive, light permeable screen 66*c* to a central processor (not shown in FIG. 3). Leads 70*b* and 70*c* provide electrical power to emitter 66*a* from a remote power source, preferably co-located with a central processor (not shown in FIG. 3). FIG. 4 shows an exploded view of sensor head 68, which includes a light sensitive detector 68*a* and a protective lens 68*b*. A light permeable conductive screen 68*c* permits conductivity measurements (described below), while a polymer coating 68*d* prevents fluid or solids agglomeration that might inhibit optical and/or conductivity sensing. Again, the polymer coating material may be a fluorosilicone polymer or a polymer with conductive properties. Lead 69*a* connects light permeable conductive screen 68*a* to a central processor (not shown in FIG. 4). Leads 69*b* and 69*c* provide output from detector 68*a* to the central processor from a remote power source, preferably co-located with a central processor (not shown in FIG. 4**).

An oscillating electric field may be employed to the conductive members/screens shown in FIGS. 3–7 to sense toner conductivity and to discourage toner filming or agglomeration in the F1, F2 flow through narrowed neck area 64 in FIG. 2. Application of an oscillating electric field across the neck area 64 fluid gap is also a useful technique for conductivity measurement. Sensor heads 66 and 68 combine conductivity and optical measurement in a single sensing device. An oscillating field applied across a gap formed by conductive surfaces is employed as a means to measure conductivity. Placement of an optically based toner concentration sensor such that the optical path passes through the electrodes of the conductivity sensor allows additional measurements to be accomplished in the same device. The amplitude, frequency and duty cycle of the oscillating electric field can be chosen such that the toner is prevented from accumulating or permanently depositing onto the electrode/window surfaces.

If only a conductivity sensing is desired, light source 66*a* and a protective lens 66*b* may be eliminated from sensor head 66 shown in FIG. 3; likewise, light sensitive detector 68*a* and a protective lens 68*b* may be eliminated from sensor head 68 shown in FIG. 4. If only optical sensing is desired, light permeable conductive screen 66*c* may be eliminated from sensor head 66 shown in FIG. 3; likewise, light permeable conductive screen 68*c* may be eliminated from sensor head 68 shown in FIG. 4.

Figure 5:
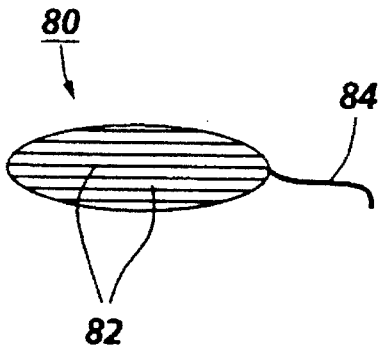
FIG. 5 is a perspective view showing a conductive member in accordance with the present invention.
Figure 6:
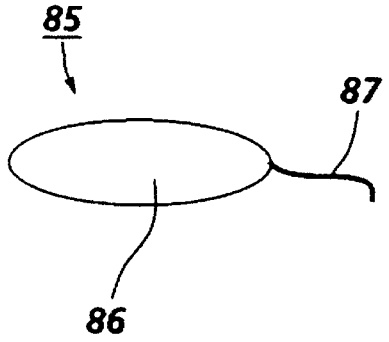
FIG. 6 is a perspective view showing another conductive member in accordance with the present invention.

FIG. 5 shows another embodiment of a light permeable conductive member 80 such as can be used in lieu of light permeable conductive screen 66C as shown and described in association with FIG. 3 and light permeable conductive screen 68C as shown and described in conjunction with FIG. 4. Light permeable conductive member 80 is shown in FIG. 5 including fine wires 82 connected by a single lead wire 84 to a central processor (shown in FIG. 9). FIG. 6 shows another embodiment of a light permeable conductive member 85, which includes a conductive coating 86 connected by a single lead 87 to a central processor. Alternatively, conductive coating 86 may be an ultrathin layer of conductive material, or a sputter coating or other thin film of light permeable conductive material applied to a lens 66*b* or 68*b* as shown in FIGS. 3 or 4, respectively.

Figure 7:
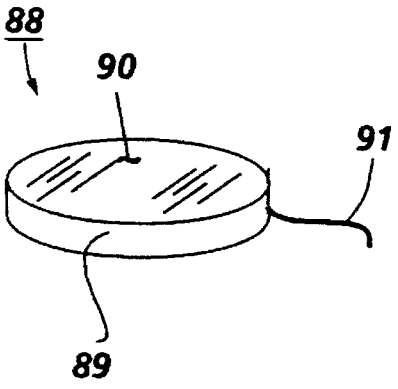
FIG. 7 is a perspective view showing a conductive member/lens in accordance with the present invention.

FIG. 7 shows a conductive NESA glass lens 88 embodiment of the present invention. NESA glass, a tin oxide coated glass manufactured by the Pittsburgh Plate Glass Company, is a commercially available example of a typical substantially transparent conductive layer supported by a transparent layer. NESA glass lens 88 includes a light-permeable lens portion 89 and a light-permeable exposed surface film 90, connected by a lead wire 91 to a central processor. If the electrode surfaces are formed using NESA glass or other optically transmissive yet electrically biasable surfaces, then the toner concentration of the ink in the conductivity cell may be determined using optical transmission/absorption techniques. Other alternatives to the NESA glass lens 88 or the screen, mesh and conductive electrodes of FIGS. 3–6 might also be employed. This would also allow the transmission of light through the cell and permit the application of oscillating electric fields needed for conductivity measurement and the prevention of toner accumulation on the windows. The interior surfaces of the cell windows could also be coated with a polymer material to further inhibit the deposition of toner particles onto the surfaces of the windows. The polymer material may be a fluorosilicone polymer or a polymer with a conductivity additive.

Figure 8:
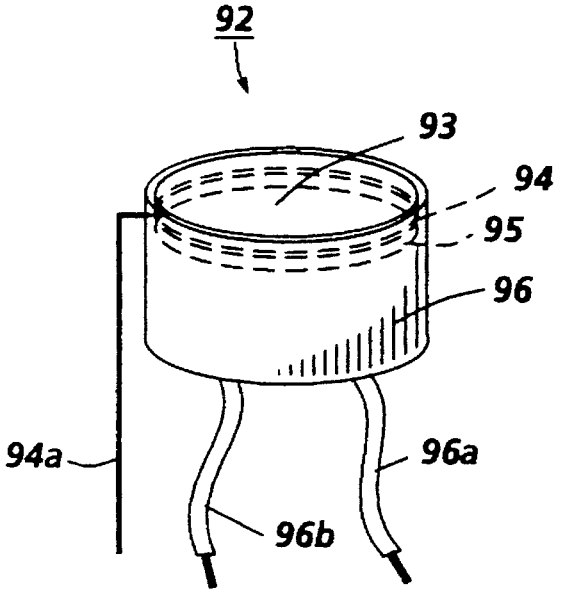
FIG. 8 is a perspective elevational view showing a sensor head in accordance with the present invention.

FIG. 8 shows still another embodiment of an emitter or detector assembly in which an emitter or detector 96 is powered by or provides information to a central processor according to leads 96*a* and 96*b*. A NESA glass lens overlies emitter or detector 96, and includes a conductive film coated on NESA glass 95, with a light and electrically permeable polymer layer 93 separating conductive and light permeable layer 94 from the fluid to be sensed. A lead 94 a provides power to or electrical detection from light permeable electrically conductive layer 94 according to the use of the device as an emitter or detector.

In a working liquid toner ink sump (FIG. 9) of a liquid ink supply system in a printing device (FIG. 10), fluids must constantly recirculate from the sump to the development station, to the photoreceptor, to various conditioners or blotters and cleaners and finally back to the sump. At the time that a batch of recirculated fluid is dispensed into the ink sump, a stream of ink from the sump can be introduced with the incoming fluid at a controlled ratio. Turbulent mixing could provide a precisely diluted sample of the receiving ink sump. At this greater dilution a highly opaque ink such as black or red, can be measured at greater values of the spacing, "l". The lower concentration and accompanying greater sensor gap would avoid clogging and provide a more robust and stable sensor. Moreover, the same sensor and electronics could be utilized for all colors with varied levels of dilution being used to achieve the desired gain.

Figure 9:
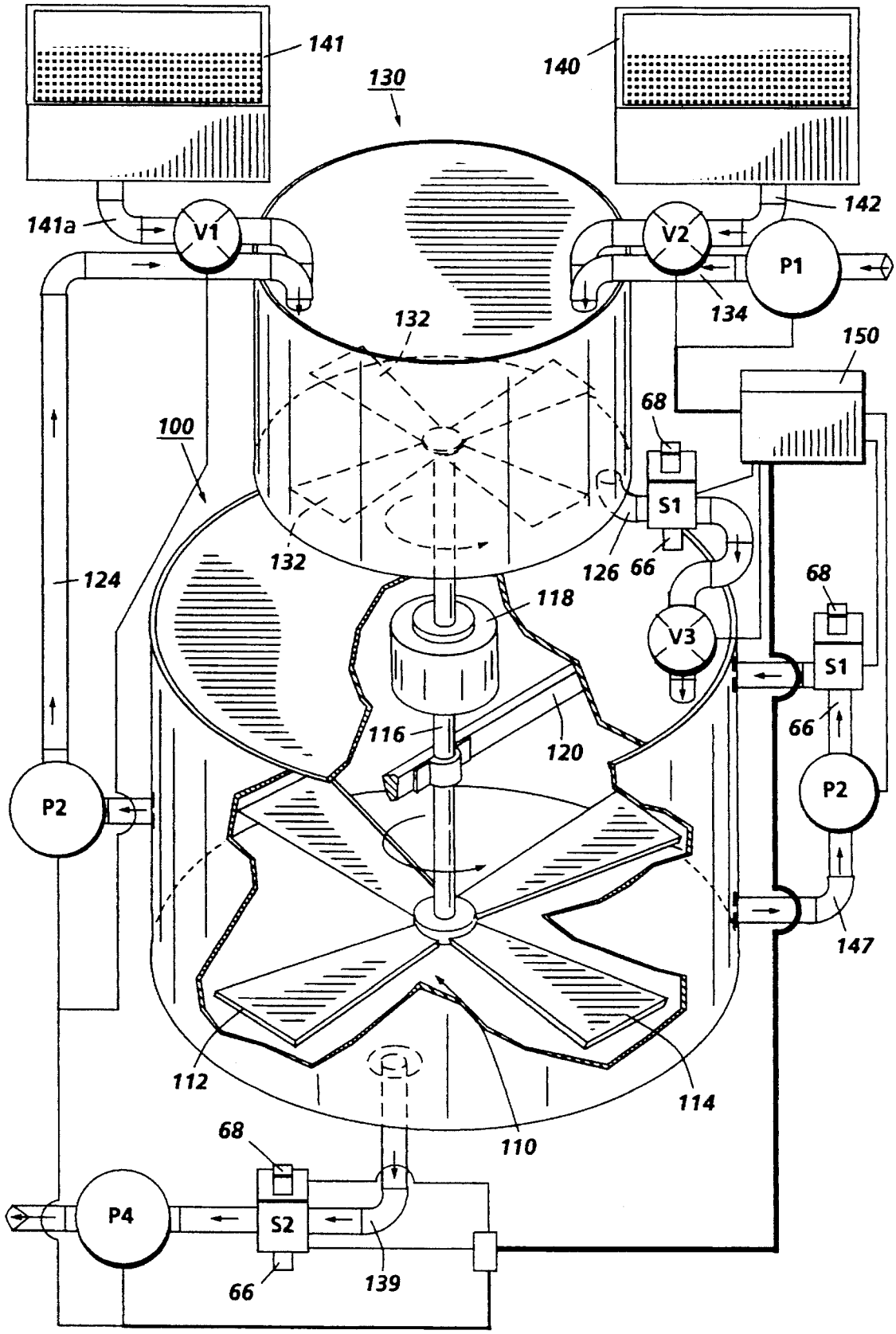
FIG. 9 is an elevational view, partially in section, showing a liquid ink toner supply arrangement in accordance with the present invention.

FIG. 9 shows another embodiment of the sensor and liquid ink/toner sump mixing system of the present invention. The FIG. 9 system includes a sump 100 having a mixing prop 110 with blades 112 and 114 for in-sump mixing of toner for a developer. Prop 110 is mounted on shaft 116, rotatably held in position on support member 120. Shaft 116 is rotated by double shaft motor 118, which is fixed by supports (not shown) to system 100. Sensing station 130 includes a mixing prop 132, also powered by a second end of shaft 116 and rotated by motor 118. Toner concentrate from toner concentrate holding station 141 is provided to sensing station 130 through pipe 141*a*, as precisely flow controlled by valve V1. Sensing station 130 may utilize diluent from diluent holding station 140 through pipe 142, as precisely flow controlled by valve V2. Mixed toner from line 124 provided from the toner sump to sensing station 130, with precise flow control by pump P2. Reclaimed toner liquids (from sources R1 and R2 of FIG. 1) are provided to sensing station 130 according to precise flow control by pump P1.

As toner is required to replenish toner sump 100, sensor S1 (including sensor heads 66 and 68, such as described in FIGS. 3 through 8 herein) may be used to optically and/or conductively sense toner flow rate, density and/or other properties of the liquid ink as it flows into the toner sump. The flow of toner from sensing station 130 to sump 100 is controlled by valve V3. As toner is required by a developer, sensor S2 (also including sensor heads 66 and 64 such as described in FIGS. 3 through 8) may likewise be used to optically and/or conductively sense toner flow rate, density and/or other properties of the liquid ink. The flow of toner from sump 100 to a developer (not shown in FIG. 9) via pipe 139 is controlled by pump P4. As discussed in association with FIGS. 3–8 above, the present invention combines optical and conductivity measurements so that sensing reliablility and flexibility is enhanced. The flexibility systems shown in FIGS. 1 and 8 permit a stream of clear recirculated and/or fresh diluent fluid to be combined with the sump contents while making a measurement of conductivity and/or optical density (percent solids) measurements. The oscillating electrical fields used in conductivity measurement enhance the reliability of optical density measurement.

Sensors S1, S2 and S3 provide input to controller 150 for indicating and controlling the various concentration, constituent and flow conditions of fluids present in a printing system. Further, the operation of valves V1, V2 and V3 and pumps P1, P2, P4 and P5 are operated by controller 150 so as to provide precise flow control of fluids present in a printing system. One important feature of the sensor and liquid ink/toner sump mixing system of the present invention is its ability to recycle and reconstitute fluids reclaimed from the photoreceptor conditioning station and the photoreceptor cleaning station so that they may be usefully employed in the printing system. A filtering or cleaning system (not shown) may be utilized to prevent impurities from being returned to the operating sump/developing system. As set forth above, rather than creating waste, these recycled/reconstituted fluids liquids may also be used as diluents to permit more accurate conductivity and optical sensing of otherwise difficult to sense liquid inks.

A toner sump sensor S3 (including sensor heads 66 and 68, such as described in FIGS. 3 through 8 herein) may be used to optically and/or conductively sense sump toner optical density, conductivity, light transmittance and/or other properties of the liquid ink as it flows via line 147 into and out of sump 100 according to pump P5. When only sump toner (T1) is circulated, the appropriate conductivity measurements with sensor S3 can be made. Optical density for troublesome toners such as black and red is difficult if not impossible with full concentration toners, in which case, a FIG. 2 dilution sensor or the like may be used to make optical density measurements, by using with recirculated (R1, R2) fluids or diluent.

A combination of conductivity and optical density measurements is taught by the present invention. Optical density measurement reliability may be enhanced by the verification of those measurements with oscillating electric field/conductivity measurements. Both measurements benefit from the multiple sources of fluid that can pass through the sensors of the present invention, by flushing impurities or otherwise removing error-inducing conditions from the system, by providing measurement reference and or set points, by checking the quality/condition of clear (recycled) fluids, by providing dilution for optical density measurement, as well as other advantages.

While the invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for sensing a fluid, comprising:

an emitter adapted to project a light beam and an electrical current into the fluid;

a detector adapted to transmit a first signal in response to receiving the light beam and a second signal in response to receiving the electrical current;

means for adding a measured quantity of diluent to the fluid for reducing a concentration of the fluid below a predetermined fluid sump level; and a processor, responsive to the first and second signals transmitted from the detector, for determining a fluid parameter.

2. The apparatus of claim 1, wherein the parameter said processor determines is an optical density of the fluid.

3. The apparatus of claim 1, wherein the parameter said processor determines is a particulate concentration of the fluid.

4. The apparatus of claim 1, wherein the parameter said processor determines is a light transmittance of the fluid.

5. The apparatus of claim 1, wherein the parameter said processor determines is an electrical conductivity.

6. The apparatus of claim 1, wherein:

said emitter includes a first light transmissive conductive layer separating said emitter from the fluid for imparting the electrical current to the fluid; and said detector includes a second light transmissive conductive layer separating said detector from the fluid for receiving the electrical current.

7. The apparatus of claim 1, wherein:

said emitter further comprises a first protective layer adjacent the fluid; and said detector further comprises a second protective layer adjacent the fluid.

8. The apparatus of claim 7, wherein said first protective layer and said second protective layer comprises polymer.

9. The apparatus of claim 1, wherein the fluid is a liquid ink.

10. The apparatus of claim 1, wherein the diluent increases a light transmissivity of the fluid.

11. The apparatus of claim 1, wherein the diluent increases an electrical conductivity of the fluid.

12. The apparatus of claim 1, further comprising means for uniformly mixing the diluent with the fluid.

13. A printing machine of the type including a fluid sensor, said sensor comprising:

an emitter adapted to project a light beam and an electrical current into the fluid;

a detector adapted to transmit a first signal in response to receiving the light beam and a second signal in response to receiving the electrical current;

means for adding a measured quantity of diluent to the fluid for reducing a concentration of the fluid below a predetermined fluid sump level; and a processor, responsive to the first and second signals transmitted from the detector, for determining a fluid parameter.

14. The printing machine of claim 13, wherein the parameter said processor determines is an optical density of the fluid.

15. The printing machine of claim 13, wherein the parameter said processor determines is a particulate concentration of the fluid.

16. The printing machine of claim 13, wherein the parameter said processor determines is a light transmittance of the fluid.

17. The printing machine of claim 13, wherein the parameter said processor determines is an electrical conductivity.

18. The printing machine of claim 13, wherein:

said emitter includes a first light transmissive conductive layer separating said emitter from the fluid for imparting the electrical current to the fluid; and said detector includes a second light transmissive conductive layer separating said detector from the fluid for receiving the electrical current.

19. The printing machine of claim 13, wherein:

said emitter further comprises a first protective layer adjacent the fluid; and said detector further comprises a second protective layer adjacent the fluid.

20. The printing machine of claim 19, wherein said first protective layer and said second protective layer comprise a fluorosilicone polymer.

21. The printing machine of claim 13, wherein the fluid is a liquid ink.

22. The printing machine of claim 13, wherein the diluent increases a light transmissivity of the fluid.

23. The printing machine of claim 13, wherein the diluent increases an electrical conductivity of the fluid.

24. The printing machine of claim 13, further comprising a photoreceptor conditioning station for reclaiming liquid, wherein said reclaimed liquid is used as the diluent.

25. The printing machine of claim 13, further comprising a photoreceptor cleaning station for reclaiming liquid, wherein said reclaimed liquid is used as the diluent.

26. The printing machine of claim 13, further comprising means for uniformly mixing the diluent with the fluid.

* * * * *